United States Patent [19]

Carrano et al.

[11] 3,954,266

[45] May 4, 1976

[54] AERIAL DART AND PADDLE GAME

[75] Inventors: Andrew J. Carrano, North Haven, Conn.; Albert Saferstein, Pelham Manor, N.Y.

[73] Assignee: Codemark Industries, Inc., Wallingford, Conn.

[22] Filed: Mar. 8, 1974

[21] Appl. No.: 449,542

[52] U.S. Cl. ..... 273/95 R; 273/96 R; 273/102 B; 273/106 A; 273/75

[51] Int. Cl.[2] ..... A63B 71/02

[58] Field of Search ..... 273/95 R, 96 R, 106 A, 273/106.5 A, 73 J, 67 R, 76, 102 B

[56] References Cited

UNITED STATES PATENTS

| | | | |
|---|---|---|---|
| 1,253,772 | 1/1918 | Bertucci | 273/106.5 A |
| 2,115,119 | 4/1938 | Park | 273/73 J |
| 2,683,037 | 7/1954 | Ruczynski | 273/106.5 A |
| 2,745,666 | 5/1956 | Swartz | 273/95 R |
| 2,860,879 | 11/1958 | Carlton | 273/106 A |
| 3,170,688 | 2/1965 | Porter | 273/67 R |
| 3,378,260 | 4/1968 | Hartel | 273/95 R |
| 3,409,301 | 11/1968 | Studen | 273/102 B |
| 3,424,460 | 1/1969 | Simpson | 273/106.5 A |

FOREIGN PATENTS OR APPLICATIONS

| | | | |
|---|---|---|---|
| 1,173,824 | 7/1964 | Germany | 273/76 |
| 462,638 | 3/1937 | United Kingdom | 273/106.5 A |

*Primary Examiner*—Richard C. Pinkham
*Assistant Examiner*—Marvin Siskind
*Attorney, Agent, or Firm*—Mattern, Ware, Davis & Stoltz

[57] ABSTRACT

By providing a suction cup dart or shuttlecock in combination with a hand-held paddle or target which incorporates a dart-adhering or holding zone and a dart-rejecting zone, a unique game is provided. Furthermore, the suction cup portion of the dart or shuttlecock is flexibly mounted to the dart body, thereby allowing the shuttlecock or dart to hit the adhering zone of the paddle or target at angles other than merely perpendicular and adhere to the surface.

9 Claims, 8 Drawing Figures

AERIAL DART AND PADDLE GAME

SUMMARY OF THE INVENTION

This invention relates to aerial dart and paddle games and more particularly to a specific construction for a paddle, a target, and a dart for use therein.

Although there are many different types of paddle games well known in the art, as well as many different types of suction cup darts and shuttlecocks, the game of this invention incorporates the use of a unique paddle and target, especially for use with darts, while also providing an extremely unique dart construction.

In most competitive paddle games, an object is hit from one player's paddle to another player, who attempts to return the object to the first player using his paddle. However, in these prior art paddle games, no real competitive game employs suction cup darts or shuttlecocks.

Another problem found in the prior art is that all of the prior art darts and shuttlecocks which incorporate a suction cupped end have the rubber suction cup securely mounted to the end of the dart or shuttlecock in a manner which prevents the suction cup portion from pivoting in any direction about the central axis of the dart. This deficiency greatly reduces the versatility of the suction cup portion and requires that the dart and shuttlecock hit the target substantially perpendicularly in order to adhere to the target.

OBJECTS OF THE INVENTION

Therefore, it is an object of this invention to provide a game employing a paddle having two zones, one for adherance of a suction cup dart thereto and another which prevents the dart from adhering thereto, whereby a competitive game using a suction cup dart or shuttlecock is achieved.

Another object of this invention is to provide a game that can be used both individually or competitively.

Another object of this invention is to provide an aerial dart capable of adhering to a surface which it hits at skewed angles.

Other objects of the invention will in part be obvious and will in part appear hereinafter.

In the game of this invention, a suction cup dart or shuttlecock is employed as the object. Generally, a suction cup dart would not be able to move from one player to the next, since the dart would tend to adhere to the paddle when the dart hits the paddle.

In order to make the game of this invention competitive, the paddle of this invention incorporates two zones, a first zone to which the aerial dart will in fact adhere, and a second zone which is constructed to prevent adherence of the suction cup thereto. In this way, by hitting the dart with the proper zone, a player is able to prevent the suction cup dart from sticking to his paddle and return it to the other player. If the first player does not hit the suction cup dart with the proper "safe" zone, the dart will stick to his paddle and the other player will score points.

In the suction cupped dart of this invention, the suction cup portion of the dart is flexibly mounted to the body of the dart or shuttlecock in a manner which allows the suction cup portion to move angularly with respect to the central axis of the dart. In this manner, the dart of this invention is capable of adhering to a surface which it hits at a skewed angle instead of only at a perpendicular angle, as with the prior art suction cup darts.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description, taken in connection with the accompanying drawings, in which.

DETAILED DESCRIPTION

Figure 1:
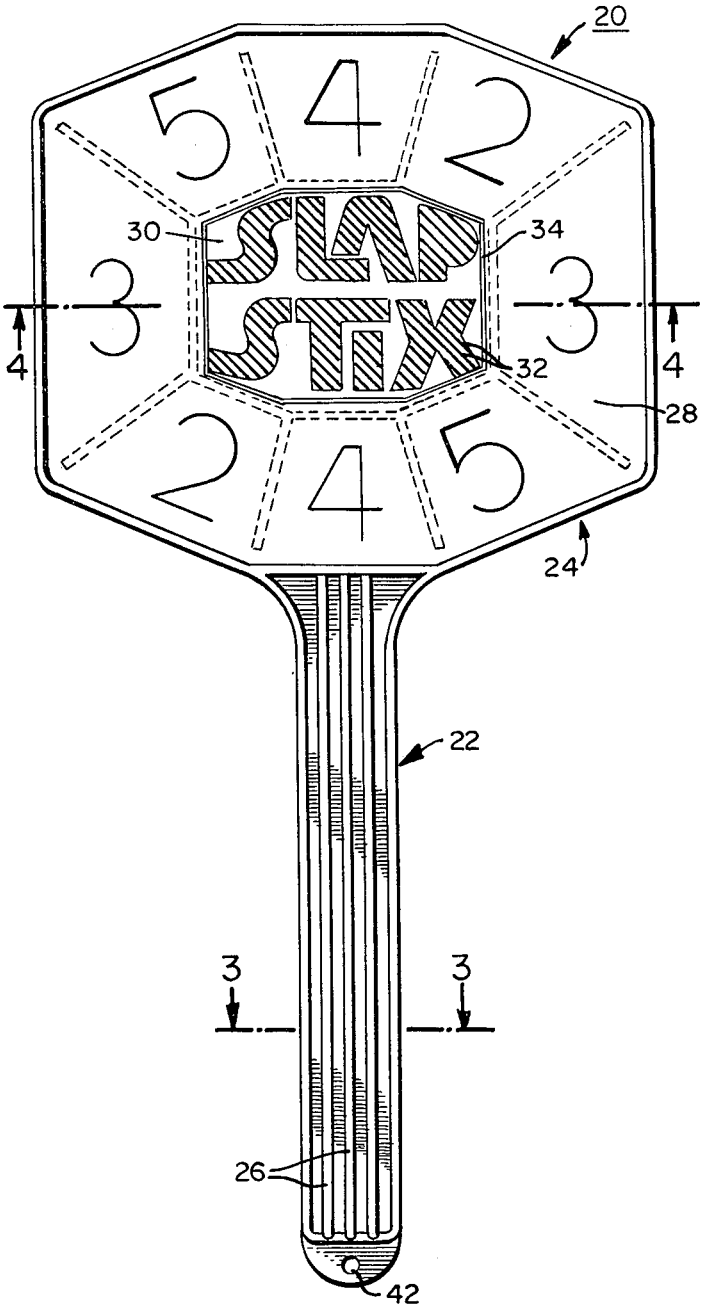
FIG. 1 is a front elevation view of the paddle of this invention.
Figure 2:
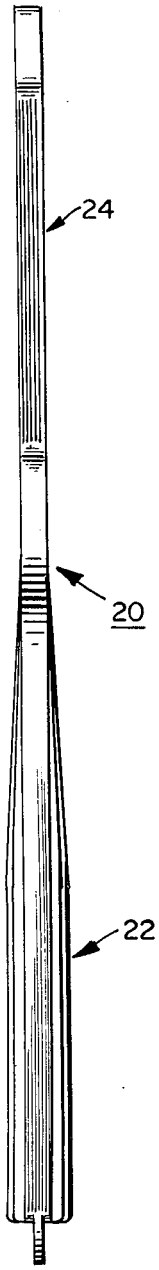
FIG. 2 is a side elevation view of the paddle of this invention.
Figure 3:
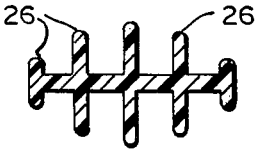
FIG. 3 is a cross-sectional end view of the shaft of the paddle of FIG. 1 taken along line 3—3 of FIG. 1.

A paddle 20 of this invention is shown in FIG. 1. Paddle 20 incorporates an arm 22 and a face 24. Arm 22 comprises an elongated member incorporating a plurality of ridges 26, best seen in FIG. 3. Arm 22 along with ridges 26 provide a very comfortable member for the player to hold the paddle and easily swing the paddle as he desires without fear of slipping from his grasp. The incorporation of ridges 26 assures a firm and complete control over the paddle's movement while substantially eliminating a large surface area that might allow perspiration to collect and thereby cause unwanted slipping from the grasp of the player.

Face 24 of paddle 20 incorporates a suction cup-adhering section 28 and a suction cup-rejecting section 30. As is obvious to one skilled in the art, face 24 can comprise any size and shape as well as sections 28 and 30 can comprise any desired size and shape. In the embodiment shown in FIG. 1, face 24 comprises an octagon with suction cup rejecting section 30 comprising an octagon centrally located within face 24, while suction cup holding section 28 comprises the remaining surface of face 24.

Section 28 comprises a substantially flat surface which is divided into eight sections, each of which incorporates a number printed therein. The number represents the points scored by the opponent when the suction cup of this dart adheres to the particular area. In order for the suction cup to adhere to this area, section 28 must comprise a substantially flat surface.

Figure 4:
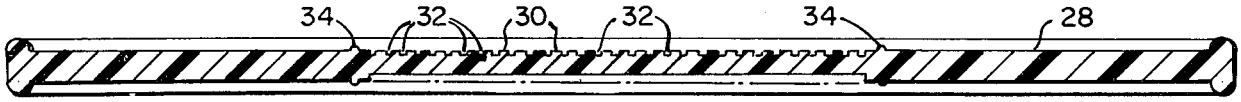
FIG. 4 is a cross-sectional end view of the paddle portion of the paddle of FIG. 1 taken along line 4—4 of FIG. 1.

In the embodiment shown in FIGS. 1 and 4, suction cup-rejecting surface 30 incorporates a plurality of grooves 32 spaced throughout section 30 in any desired configuration. The only requirement is that grooves 32 are sufficiently spaced throughout section 30 in order to prevent the suction cup from adhering to any area within section 30. As a result, there must be a sufficient number of grooves 32 within section 30 so that there will be no flat surface in section 30 which is greater than the diameter of the suction cup. In the embodiment shown in FIG. 1, the trademark of the product has been incorporated into the grooved sections as a matter of convenience of advertising.

Furthermore, in order to assure that no suction cup dart which is substantially within the safe zone 30 will adhere thereto, an additional ridge 34 is positioned peripherally surrounding and defining section 30. Although ridge 34 has been found to be optional, it does provide additional means to prevent the suction cup from adhering to section 30 or any portion thereof, while also assuring clear definition of the suction cup-rejecting section 30.

Figure 5:
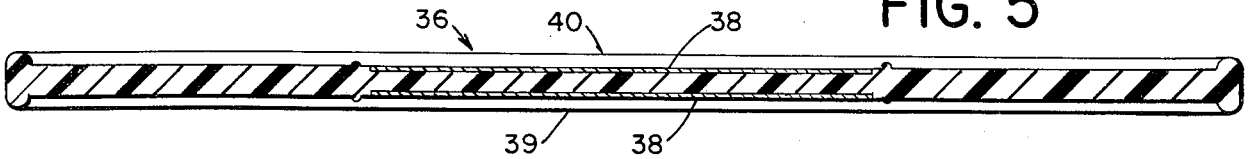
FIG. 5 is a cross-sectional end view of the paddle portion similar to FIG. 4, but showing a second embodiment for the paddle portion.

As is obvious to one skilled in the art, the particular size and shape of face 24, as well as the configuration of suction cup-adhering section 28 and suction cup-rejecting section 30, are matters of design choice and can be altered in many different ways. Furthermore, grooves 32 or ridges 34 are not the only means in which section 30 can be constructed in order to assure that the suction cup will not adhere to this particular section. As shown in FIG. 5, another embodiment for providing a non-adhering section 30 is shown. In FIG. 5, a suction cup non-adhering surface 36 is shown in cross-section, forming part of paddle face 24. In this embodiment, non-adhering suction cup section 36 comprises adhesive material 38 having one adhesive surface which will adhere to face 24 of paddle 20, while having surface 40 which incorporates a plurality of ridges stamped into the material in any desired configuration, preferably overlapping, in order to provide a sufficiently irregular surface, assuring that the suction cup will not adhere thereto.

As shown in FIGS. 4 and 5, in the preferred embodiment, face 24 of paddle 20 comprises the same construction on both the front and the back. In this manner, paddle 20 can be used for forehands and backhands without switching around the paddle. This makes the game much more enjoyable and assures that all ages can quickly adapt to paddle 20 and quickly understand and use paddle 20 for the enjoyment of the game of this invention.

Paddle 20 can also be mounted on a wall or hung on a hook, using convenient mounting hole 42 located in the base of arm 22, in order to use paddle 20 as a dart board, testing the skill of the player to hit the zones which score points, while keeping away from the zones which will not allow the suction cup dart to adhere to it. In this way, paddle 20 of this invention can be employed competitively as a game in which the suction cup dart is hit from player to player, scoring points when one of the players is unable to keep the suction cup dart away from the dart-receiving section; or else can be employed individually with one person throwing the suction cupped darts at face 24 of paddle 20.

Figure 6:
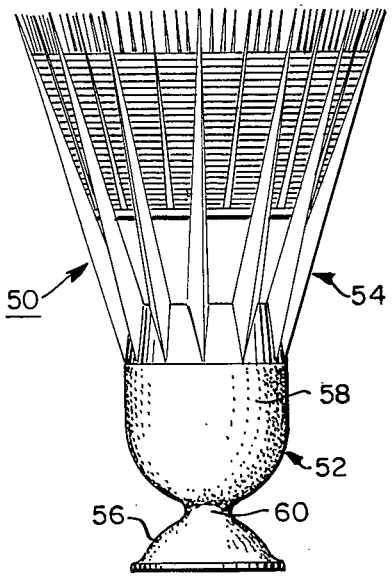
FIG. 6 is a side elevation view of the suction cupped aerial dart of this invention.

In FIG. 6, one embodiment of the dart 50 of this invention is shown. Dart 50 incorporates a flexible tip 52 and a typical shuttlecock body 54. Flexible tip 52 incorporates a suction cup portion 56, a shuttlecock mounting portion 58, and an interconnecting stem 60. In the preferred embodiment, the entire flexible tip 52 is manufactured from rubber-like material in order to assure its complete flexibility.

In most prior art dart constructions, the suction cup is fixedly mounted to the body of the dart or the shuttle cock. Such a construction prevents the suction cup portion from angularly flexing off the central axis of the dart, thereby preventing adherence to a surface when the dart is thrown at angles substantially divergent from directly perpendicular to the target.

In the rubber tip construction of this invention, suction cup portion 56 is flexibly mounted to the mounting portion 58 of tip 52 by means of stem 60, as well as the flexibility of the tip itself. In this manner, suction cup 56 will adhere to a surface when thrown at angular relationship to that surface, since suction cup 56 is capable of pivoting about the central axis of dart 50 due to the inherent flexibility of the construction of tip 52. It has been found that the dart 50 with tip 52 of this invention will adhere to surfaces when thrown at angles even greater than 45 degrees from the perpendicular to the target.

Figure 7:
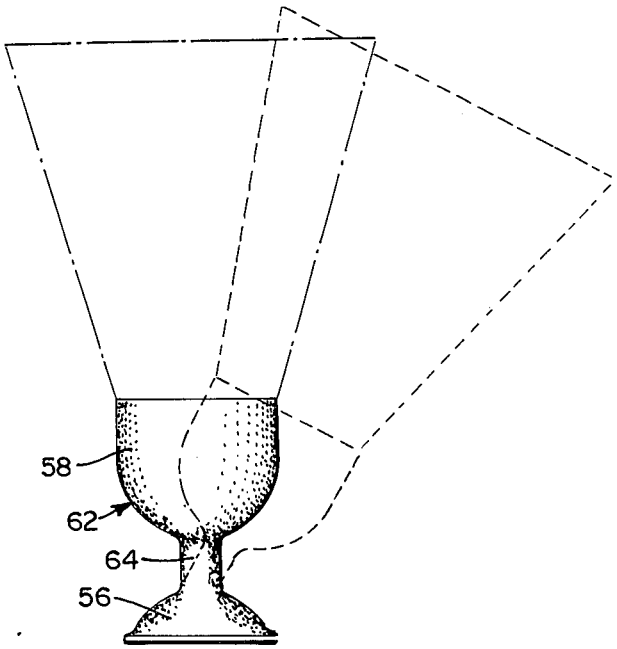
FIG. 7 is a side elevation view of another embodiment of the rubber tipped suction cup of this invention.

In FIG. 7, another embodiment of the flexible tip of this invention is shown. Therein, flexible tip 62 comprises a suction cup portion 56 and a mounting portion 58 and a somewhat different stem portion 64. Stem portion 64 of flexible tip 62 is substantially longer than the flexible tip 52 shown in FIG. 6. By employing a longer stem 64 in the tip 62 of this invention, greater angular variations from the perpendicular can be employed, while still having the dart to which the tip is mounted adhere to the target.

It has been found that by employing flexible tip 62, angles greater than 65 degrees from the perpendicular to the target can be successfully used while still having suction cup 56 adhere to the target surface.

Although the flexible "angle" tip of this invention is extremely applicable to the game of this invention, a variety of applications for this tip are clearly available in other well-known suction cup dart games and other similar games employing suction cups.

Figure 8:
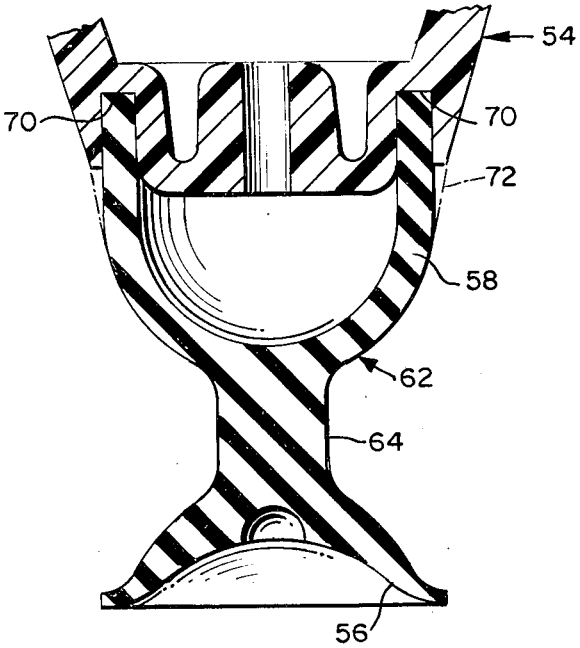
FIG. 8 is a cross-sectional side elevation view showing one embodiment of the flexible rubber tipped suction cup of this invention mounted to the dart body.

When the paddle of this invention is employed in a competitive atmosphere, the suction cup dart will approach the paddle at a variety of angles and should adhere to the suction cup-adhering section of the paddle whenever the dart contacts that angle. If the dart were only able to adhere to that particular section when the dart hits a substantially perpendicular angle, much enjoyment would be eliminated from the game. However, by employing a dart which incorporates the flexible rubber tip of this invention, the angle at which the dart contacts the target surface does not matter and will adhere to that surface regardless of the particular angle. The rubber tips of this invention are constructed in order to allow these rubber tips to be mounted quickly and easily to the shuttlecock or dart. As shown in FIG. 8, shuttlecock body 54 incorporates a recess groove 70. Mounting portion 58 of flexible tip 62 is inserted into groove 70, thereby securing flexible tip 62 to shuttlecock body 54. If desired, an optional lip 72 can be incorporated on the outer surface of mounting portion 58, in order to quickly indicate when the desired portion of mounting portion 58 has been inserted into groove 70.

In this manner, the various embodiments of the rubber tip of this invention can be quickly and easily interchanged on the shuttle cock body 54. It has been found that although both embodiments can be used interchangeably, players of the game of this invention may find one type preferable for individual play, while the other type is preferable for competitive play. In this way, the flexible tip of this invention can be easily interchanged on the shuttlecock body, reducing the expense to the player for having different shuttlecocks for different games.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by letters patent is:

We claim:

1. An aerial dart game comprising:

A. a dart incorporating a suction cup at its end; and

B. a unitary molded target face incorporating:

a. a dart-adhering surface for receiving and holding the suction cup of the dart thereto, and comprising:

1. a major area of said target face extending about the periphery of said target face, and

2. a plurality of zones each having indicia market thereon for assessing a score to a player for having the said dart land on said dart-adhering surface, b. a dart-rejecting surface centrally located on said face for preventing adherence thereto of the suction cup of the dart, and c. a continuous ridge

1. peripherally surrounding said dart-rejecting surface forming a precise demarcation between said dart-rejecting surface and said dart-adhering surface, and

2. cooperating with said dart-rejecting surface to prevent adherance of any dart straddling said ridge into said dart-rejecting surface, whereby adherence of said suction cup to said target face while substantially within non-adhering zone is prevented and a score is readily determined for adherence to said dart-adhering surface.

2. An aerial dart game comprising:

A. a dart incorporating a suction cup at its end; and

B. a unitary molded paddle comprising a. a handle portion for manipulation of the paddle, and b. a target face portion incorporating

1. a dart-adhering surface for receiving and holding thereon the suction cup of the dart, and comprising aa. a major area of said target face extending peripherally about said face, and bb. a plurality of zones each having indicia marked thereon for assessing a score to a player for having said dart land on said dart-adhering surface,

2. a dart-rejecting surface centrally located on said face for preventing adherence thereto of the suction cup of the dart, and

3. a continuous ridge peripherally surrounding said dart-rejecting surface forming a precise demarcation between said dart-rejecting surface and said dart-adhering surface,

4. cooperating with said dart-rejecting surface to prevent adherance of any dart straddling said ridge into said dart-rejecting surface, whereby accurate substantially central contact of said dart with said paddle target face is promoted, adherence of said suction cup to said target face while substantially within said non-adhering zone is prevented, and a score is readily determined.

3. The aerial dart game defined in claim 2, wherein said handle portion is further defined as comprising a plurality of upstanding fins providing a comfortable non-slip gripping surface.

4. The aerial dart game defined in claim 2, wherein said dart-rejecting surface incorporates a plurality of grooves spaced throughout said surface, thereby assuring non-retention of the suction cup to said surface.

5. The aerial dart game defined in claim 2, wherein said dart-rejecting surface comprises a plurality of ridges spaced throughout said surface to assure non-retention of the dart to said surface.

6. An aerial dart game comprising:

A. a dart incorporating:

a. a body portion, and b. a flexible tip mounted to said body portion and comprising

1. a flexible suction cup portion,

2. a flexible mounting portion secured to said body of the dart, and

3. a flexible, stem portion interconnecting said suction cup portion with said mounting portion; and B. a target face portion incorporating:

a. a dart-rejecting surface centrally located on said target face portion incorporating a plurality of grooves

1. spaced throughout said surface preventing adherence of the suction cup of the dart to said surface and comprising a minor area of said target face, and

2. said grooves being formed on said surface in a plurality of variable patterns, each of said patterns comprising an indicia, b. a dart-adhering surface comprising:

1. the major area of said target face portion,

2. peripherally disposed about said dart-rejecting surface, and

3. incorporating a plurality of zones each having indicia marked therein for assessing a score to a player for having said dart land on said dart-adhering surface; and c. a continuous ridge

1. peripherally surrounding said dart-rejecting surface forming a precise demarcation between said dart-rejecting surface and said dart-adhering surface,

2. cooperating with said dart-rejecting surface to prevent adherance of any dart straddling said ridge into said dart-rejecting surface, whereby adherence of said suction cup to said target face while substantially within said non-adhering zone is prevented, and a score is readily determined.

7. The aerial dart game defined in claim 6, wherein said patterns of indicia formed by the plurality of grooves on the dart-rejecting surface each comprise alphabetic letters.

8. The aerial dart game defined in claim 7, wherein said letters taken in combination with adjacent letters form words.

9. An aerial dart game comprising:

A. a dart incorporating:

a. a body portion, and b. a flexible tip mounted to said body portion and comprising

1. a flexible suction cup portion,

2. a flexible mounting portion secured to said body of the dart, and

3. a flexible stem portion interconnecting said suction cup portion with said mounting portion; and B. a unitary, molded paddle comprising:

a. a handle portion formed by a plurality of elongated upstanding fins for manipulation of the paddle, and b. a target face portion incorporating:

1. a dart-rejecting surface centrally located on said target face portion incorporating a plurality of grooves aa. spaced throughout said surface preventing adherance to the suction cup of the dart to said surface and comprising a minor area of said target face, and bb. said grooves being formed on said surface in a plurality of variable patterns, each of said patterns comprising an indicia,

2. a dart adhering surface aa. comprising the major area of said target face portion, bb. peripherally disposed about said dart-rejecting surface, and cc. incorporating a plurality of zones each having indicia marked therein for assessing a score to a player for having said dart land in said dart-adhering surface; and

3. a continuous ridge peripherally surrounding said dart-rejecting surface forming a precise demarcation between said dart-rejecting surface and said dart-adhering surface,

4. cooperating with said dart-rejecting surface to prevent adherance of any dart straddling said ridge into said dart-rejecting surface, whereby accurate substantially central contact of said dart with said paddle target face is promoted, adherence of said suction cup to said target face while substantially within said non-adhering zone is prevented, and a score is readily determined.

* * * * *